US011149930B2

(12) United States Patent
McIntyre et al.

(10) Patent No.: US 11,149,930 B2
(45) Date of Patent: Oct. 19, 2021

(54) AREA LIGHT

(71) Applicant: MILWAUKEE ELECTRIC TOOL CORPORATION, Brookfield, WI (US)

(72) Inventors: Ross McIntyre, Wauwatosa, WI (US); Kyle Harvey, Wauwatosa, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 16/990,465

(22) Filed: Aug. 11, 2020

(65) Prior Publication Data

US 2020/0370739 A1 Nov. 26, 2020

Related U.S. Application Data

(63) Continuation of application No. 15/200,037, filed on Jul. 1, 2016, now Pat. No. 10,775,032.
(Continued)

(51) Int. Cl.
*F21V 23/00* (2015.01)
*F21V 21/40* (2006.01)
(Continued)

(52) U.S. Cl.
CPC ..... *F21V 23/003* (2013.01); *F21S 9/02* (2013.01); *F21V 5/04* (2013.01); *F21V 21/406* (2013.01);
(Continued)

(58) Field of Classification Search
None
See application file for complete search history.

(56) References Cited

U.S. PATENT DOCUMENTS 3,226,536 A 12/1965 Atkin et al.
3,331,958 A 7/1967 Adler
(Continued)

FOREIGN PATENT DOCUMENTS

EP 193756 9/1986
EP 1205428 5/2002
(Continued)

OTHER PUBLICATIONS

International Search Report and Written Opinion for Application No. PCT/US2017/018412 dated May 23, 2017 (13 pages).
(Continued)

*Primary Examiner* — Britt D Hanley
(74) *Attorney, Agent, or Firm* — Michael Best & Friedrich LLP

(57) ABSTRACT

An area light includes a housing defining a central axis. A lens is coupled to a first end of the housing and a light assembly is disposed within the lens. The light assembly includes one or more LEDs. A battery is selectively coupled to a battery port and arranged to provide power to the LEDs. A hook is coupled to a second end of the housing. A slot on the second end of the housing is configured to receive a support member that is configured to support the light. A user interface includes a first control member configured to turn the one or more LEDs on and off, and a second control member configured to switch the intensity of the one or more LEDs. A control unit controls power to the one or more LEDs. The light passing through the lens has a range of between 3500 and 5500 lumens.

22 Claims, 8 Drawing Sheets

Related U.S. Application Data

(60) Provisional application No. 62/299,757, filed on Feb. 25, 2016, provisional application No. 62/187,539, filed on Jul. 1, 2015.

(51) Int. Cl.

| | |
|---|---|
| ***F21S 9/02*** | (2006.01) |
| ***H05B 45/00*** | (2020.01) |
| ***H05B 47/10*** | (2020.01) |
| ***F21V 5/04*** | (2006.01) |
| ***F21L 4/02*** | (2006.01) |
| ***F21L 14/02*** | (2006.01) |
| ***F21Y 115/10*** | (2016.01) |
| ***F21W 131/10*** | (2006.01) |
| ***F21V 23/04*** | (2006.01) |
| ***F21V 29/74*** | (2015.01) |

(52) U.S. Cl.

CPC ..... *H05B 45/00* (2020.01); *H05B 47/10* (2020.01); *F21L 4/02* (2013.01); *F21L 14/02* (2013.01); *F21V 23/04* (2013.01); *F21V 29/74* (2015.01); *F21W 2131/1005* (2013.01); *F21Y 2115/10* (2016.08)

(56) References Cited

U.S. PATENT DOCUMENTS

| | | | |
|---|---|---|---|
| 3,755,668 | A | 8/1973 | Moreschini |
| 4,032,771 | A | 6/1977 | Ilzig |
| 4,228,489 | A | 10/1980 | Martin |
| 4,268,894 | A | 5/1981 | Bartunek et al. |
| 4,324,477 | A | 4/1982 | Miyazaki |
| 5,203,621 | A | 4/1993 | Weinmeister et al. |
| 5,207,747 | A | 5/1993 | Gordin et al. |
| 5,351,172 | A | 9/1994 | Attree et al. |
| 5,400,234 | A | 3/1995 | Yu |
| 5,428,520 | A | 6/1995 | Skief |
| 5,630,660 | A | 5/1997 | Chen |
| 5,860,729 | A | 1/1999 | Bamber |
| 5,934,628 | A | 8/1999 | Bosnakovic |
| 5,964,524 | A | 10/1999 | Qian |
| 6,045,240 | A | 4/2000 | Hochstein |
| D428,176 | S | 7/2000 | Bamber et al. |
| 6,092,911 | A | 7/2000 | Baker, III et al. |
| 6,099,142 | A | 8/2000 | Liu |
| 6,149,283 | A | 11/2000 | Conway et al. |
| 6,183,114 | B1 | 2/2001 | Cook et al. |
| 6,213,626 | B1 | 4/2001 | Qian |
| 6,255,786 | B1 | 7/2001 | Yen |
| 6,265,969 | B1 | 7/2001 | Shih |
| D452,022 | S | 12/2001 | Osiecki et al. |
| 6,367,949 | B1 | 4/2002 | Pederson |
| 6,379,023 | B1 | 4/2002 | Passno |
| 6,461,017 | B2 | 10/2002 | Selkee |
| 6,474,844 | B1 | 11/2002 | Ching |
| 6,554,459 | B2 | 4/2003 | Yu et al. |
| 6,637,904 | B2 | 10/2003 | Hernandez |
| 6,824,297 | B1 | 11/2004 | Lee |
| 6,854,862 | B1 | 2/2005 | Hopf |
| 6,857,756 | B2 | 2/2005 | Reiff et al. |
| 6,873,249 | B2 | 3/2005 | Chu |
| 6,877,881 | B2 | 4/2005 | Tsao |
| 6,899,441 | B2 | 5/2005 | Chen |
| D506,847 | S | 6/2005 | Hussaini et al. |
| 6,902,294 | B2 | 6/2005 | Wright |
| 6,926,428 | B1 | 8/2005 | Lee |
| 7,001,044 | B2 | 2/2006 | Leen |
| 7,001,047 | B2 | 2/2006 | Holder et al. |
| 7,011,280 | B2 | 3/2006 | Murray et al. |
| 7,063,444 | B2 | 6/2006 | Lee et al. |
| 7,073,926 | B1 | 7/2006 | Kremers et al. |
| D532,536 | S | 11/2006 | Krieger et al. |
| 7,152,997 | B1 | 12/2006 | Kovacik et al. |
| 7,153,004 | B2 | 12/2006 | Galli |
| 7,194,358 | B2 | 3/2007 | Callaghan et al. |
| 7,195,377 | B2 | 3/2007 | Tsai |
| 7,224,271 | B2 | 5/2007 | Wang |
| D553,281 | S | 10/2007 | Rugendyke et al. |
| D553,771 | S | 10/2007 | Watson et al. |
| 7,278,761 | B2 | 10/2007 | Kuan |
| 7,350,940 | B2 | 4/2008 | Haugaared et al. |
| 7,364,320 | B2 | 4/2008 | Van Deursen et al. |
| 7,367,695 | B2 | 5/2008 | Shiau |
| 7,470,036 | B2 | 12/2008 | Deighton et al. |
| 7,484,858 | B2 | 2/2009 | Deighton |
| 7,503,530 | B1 | 3/2009 | Brown |
| 7,566,151 | B2 | 7/2009 | Whelan et al. |
| 7,618,154 | B2 | 11/2009 | Rosiello |
| 7,638,970 | B1 | 12/2009 | Gebhard et al. |
| D612,965 | S | 3/2010 | Extrand |
| 7,670,034 | B2 | 3/2010 | Zhang et al. |
| D621,536 | S | 8/2010 | Lee |
| D622,430 | S | 8/2010 | Chilton |
| 7,798,684 | B2 | 9/2010 | Boissevain |
| 7,828,465 | B2 | 11/2010 | Roberge et al. |
| 7,857,486 | B2 | 12/2010 | Long et al. |
| 7,914,178 | B2 | 3/2011 | Xiang et al. |
| 7,914,182 | B2 | 3/2011 | Mrakovich et al. |
| 7,972,036 | B1 | 7/2011 | Schach et al. |
| D643,138 | S | 8/2011 | Kawase et al. |
| 7,988,335 | B2 | 8/2011 | Liu et al. |
| 7,990,062 | B2 | 8/2011 | Liu |
| 7,997,753 | B2 | 8/2011 | Walesa |
| 8,007,128 | B2 | 8/2011 | Wu et al. |
| 8,007,145 | B2 | 8/2011 | Leen |
| 8,029,169 | B2 | 10/2011 | Liu |
| 8,047,481 | B2 | 11/2011 | Shen |
| 8,087,797 | B2 | 1/2012 | Pelletier et al. |
| 8,142,045 | B2 | 3/2012 | Peak |
| 8,167,466 | B2 | 5/2012 | Liu |
| D661,417 | S | 6/2012 | Kung |
| 8,201,979 | B2 | 6/2012 | Deighton et al. |
| D665,521 | S | 8/2012 | Werner et al. |
| 8,235,552 | B1 | 8/2012 | Tsuge |
| 8,262,248 | B2 | 9/2012 | Wessel |
| 8,294,340 | B2 | 10/2012 | Yu et al. |
| 8,322,892 | B2 | 12/2012 | Scordino et al. |
| 8,328,398 | B2 | 12/2012 | Van Deursen |
| 8,330,337 | B2 | 12/2012 | Yu et al. |
| 8,360,607 | B2 | 1/2013 | Bretschneider et al. |
| 8,366,290 | B2 | 2/2013 | Maglica |
| 8,403,522 | B2 | 3/2013 | Chang |
| 8,425,091 | B2 | 4/2013 | Chen |
| 8,439,531 | B2 | 5/2013 | Trott et al. |
| 8,465,178 | B2 | 6/2013 | Wilcox et al. |
| 8,485,691 | B2 | 7/2013 | Hamel et al. |
| D687,591 | S | 8/2013 | Chilton et al. |
| 8,547,022 | B2 | 10/2013 | Summerford et al. |
| D694,445 | S | 11/2013 | Shiu |
| D695,434 | S | 12/2013 | Shen |
| 8,599,097 | B2 | 12/2013 | Intravatola |
| D698,471 | S | 1/2014 | Poon |
| D699,874 | S | 2/2014 | Chilton et al. |
| 8,651,438 | B2 | 2/2014 | Deighton et al. |
| 8,659,433 | B2 | 2/2014 | Petrou |
| 8,692,444 | B2 | 4/2014 | Patel et al. |
| 8,696,177 | B1 | 4/2014 | Frost |
| D705,467 | S | 5/2014 | Aglassinger |
| D706,968 | S | 6/2014 | McDonough et al. |
| D708,376 | S | 7/2014 | Crowe et al. |
| 8,801,226 | B2 | 8/2014 | Moore |
| 8,851,699 | B2 | 10/2014 | McMillan |
| 8,858,016 | B2 | 10/2014 | Strelchuk |
| 8,858,026 | B2 | 10/2014 | Lee et al. |
| 8,939,602 | B2 | 1/2015 | Wessel |
| 8,979,331 | B2 | 3/2015 | Lee et al. |
| D726,354 | S | 4/2015 | Davies |
| D728,402 | S | 5/2015 | Case |
| D729,428 | S | 5/2015 | Shen |
| 9,060,407 | B2 * | 6/2015 | West ..... G06F 3/0679 |
| 9,068,736 | B2 | 6/2015 | Lee et al. |
| 9,182,088 | B2 | 11/2015 | Workman et al. |
| D747,263 | S | 1/2016 | Lafferty |

(56) References Cited

U.S. PATENT DOCUMENTS

| | | | |
|---|---|---|---|
| 9,713,216 | B2 | 7/2017 | Urry et al. |
| D794,235 | S | 8/2017 | Green |
| 9,851,088 | B2 | 12/2017 | Kyle et al. |
| D809,687 | S | 2/2018 | Krantz et al. |
| D822,246 | S | 7/2018 | Hou |
| D828,939 | S | 9/2018 | Bo |
| D844,875 | S | 4/2019 | Jeon |
| D911,565 | S | 2/2021 | Bertken |
| D914,937 | S | 3/2021 | Liu |
| 2002/0136005 | A1 | 9/2002 | Lee |
| 2002/0167814 | A1 | 11/2002 | Ching |
| 2002/0191396 | A1 | 12/2002 | Reiff et al. |
| 2003/0090904 | A1 | 5/2003 | Ching |
| 2003/0137847 | A1 | 7/2003 | Cooper |
| 2003/0174503 | A1 | 9/2003 | Yueh |
| 2005/0265035 | A1 | 12/2005 | Brass et al. |
| 2006/0007682 | A1 | 1/2006 | Reiff, Jr. et al. |
| 2006/0067077 | A1 | 3/2006 | Kumthampinij et al. |
| 2006/0146550 | A1 | 7/2006 | Simpson et al. |
| 2006/0203478 | A1 | 9/2006 | Waters |
| 2006/0279948 | A1 | 12/2006 | Tsai |
| 2006/0285323 | A1 | 12/2006 | Fowler |
| 2007/0211470 | A1 | 9/2007 | Huang |
| 2007/0297167 | A1 | 12/2007 | Greenhoe |
| 2008/0112170 | A1 | 5/2008 | Trott et al. |
| 2008/0158887 | A1 | 7/2008 | Zhu et al. |
| 2008/0165537 | A1 | 7/2008 | Shiau |
| 2008/0198588 | A1 | 8/2008 | O'Hern |
| 2008/0253125 | A1 | 10/2008 | Kang et al. |
| 2008/0302933 | A1 | 12/2008 | Cardellini |
| 2009/0080205 | A1 | 3/2009 | Chang et al. |
| 2009/0134191 | A1 | 5/2009 | Phillips |
| 2009/0135594 | A1 | 5/2009 | Yu et al. |
| 2009/0303717 | A1 | 12/2009 | Long et al. |
| 2010/0027260 | A1 | 2/2010 | Liu |
| 2010/0027269 | A1 | 2/2010 | Lo et al. |
| 2010/0072897 | A1 | 3/2010 | Zheng |
| 2010/0080005 | A1 | 4/2010 | Gattari |
| 2010/0091495 | A1 | 4/2010 | Patrick |
| 2010/0142213 | A1 | 6/2010 | Bigge et al. |
| 2010/0315824 | A1 | 12/2010 | Chen |
| 2010/0328951 | A1 | 12/2010 | Boissevain |
| 2011/0031887 | A1 | 2/2011 | Stoll et al. |
| 2011/0038144 | A1 | 2/2011 | Chang |
| 2011/0050070 | A1 | 3/2011 | Pickard |
| 2011/0058367 | A1 | 3/2011 | Shiau et al. |
| 2011/0075404 | A1 | 3/2011 | Allen et al. |
| 2011/0089838 | A1 | 4/2011 | Pickard et al. |
| 2011/0121727 | A1 | 5/2011 | Sharrah et al. |
| 2011/0156584 | A1 | 6/2011 | Kim |
| 2011/0228524 | A1 | 9/2011 | Greer |
| 2011/0286216 | A1 | 11/2011 | Araman |
| 2011/0317420 | A1 | 12/2011 | Jeon et al. |
| 2012/0026729 | A1 | 2/2012 | Sanchez et al. |
| 2012/0033400 | A1 | 2/2012 | Remus et al. |
| 2012/0033429 | A1 | 2/2012 | Van De Ven |
| 2012/0044707 | A1 | 2/2012 | Breidenassel |
| 2012/0048511 | A1 | 3/2012 | Moshtagh |
| 2012/0049717 | A1 | 3/2012 | Lu |
| 2012/0057351 | A1 | 3/2012 | Wilcox et al. |
| 2012/0087118 | A1 | 4/2012 | Bailey et al. |
| 2012/0087125 | A1 | 4/2012 | Liu |
| 2012/0098437 | A1 | 4/2012 | Smed |
| 2012/0120674 | A1 | 5/2012 | Jonker |
| 2012/0140455 | A1 | 6/2012 | Chang et al. |
| 2012/0155104 | A1 | 6/2012 | Jonker |
| 2012/0212963 | A1 | 8/2012 | Jigamain |
| 2012/0234519 | A1 | 9/2012 | Lee |
| 2012/0236551 | A1 | 9/2012 | Sharrah et al. |
| 2012/0247735 | A1 | 10/2012 | Ito et al. |
| 2012/0262917 | A1 | 10/2012 | Courcelle |
| 2012/0300487 | A1 | 11/2012 | Jonker |
| 2013/0032323 | A1 | 2/2013 | Hsu |
| 2013/0058078 | A1 | 3/2013 | Meng |
| 2013/0077296 | A1 | 3/2013 | Goeckel et al. |
| 2013/0128565 | A1 | 5/2013 | Cugini et al. |
| 2013/0176713 | A1 | 7/2013 | Deighton et al. |
| 2013/0187785 | A1 | 7/2013 | McIntosh et al. |
| 2013/0258645 | A1 | 10/2013 | Weber et al. |
| 2013/0265780 | A1 | 10/2013 | Choski et al. |
| 2013/0322073 | A1 | 12/2013 | Hamm et al. |
| 2014/0140050 | A1 | 5/2014 | Wong et al. |
| 2014/0192543 | A1 | 7/2014 | Deighton et al. |
| 2014/0218936 | A1 | 8/2014 | Mahling et al. |
| 2014/0268775 | A1 | 9/2014 | Kennemer et al. |
| 2014/0301066 | A1 | 10/2014 | Inskeep |
| 2014/0307443 | A1 | 10/2014 | Clifford et al. |
| 2014/0376216 | A1 | 12/2014 | McLoughlin et al. |
| 2015/0023771 | A1 | 1/2015 | Carr et al. |
| 2015/0233569 | A1 | 8/2015 | Xue et al. |
| 2015/0233571 | A1 | 8/2015 | Inan et al. |
| 2015/0267882 | A1* | 9/2015 | O'Brien ..... F21L 4/08 362/183 |
| 2015/0267902 | A1 | 9/2015 | Zhang |
| 2016/0348879 | A1 | 12/2016 | Young et al. |
| 2016/0360585 | A1 | 12/2016 | Urry et al. |
| 2017/0280528 | A1 | 9/2017 | Urry et al. |

FOREIGN PATENT DOCUMENTS

| | | |
|---|---|---|
| EP | 2436641 | 4/2012 |
| GB | 2424694 | 10/2006 |
| KR | 20100089371 | 8/2010 |
| KR | 20100116933 | 11/2010 |
| WO | 2002044503 | 6/2002 |
| WO | 2011073828 | 6/2011 |
| WO | 2011112005 | 9/2011 |
| WO | 2014083117 | 6/2014 |
| WO | 2014207595 | 12/2014 |

OTHER PUBLICATIONS

European Patent Office Partial Supplementary Search Report for Application No. 17757035.5 dated Sep. 19, 2019 (14 pages).

European Patent Office Extended Search Report for Application No. 17757035.5 dated Jan. 3, 2020 (11 pages).

* cited by examiner

AREA LIGHT

RELATED APPLICATION DATA

This application is a continuation of co-pending U.S. Non-provisional application Ser. No. 15/200,037, filed Jul. 1, 2016, now U.S. Pat. No. 10,775,032, which claims priority to U.S. Provisional Application No. 62/299,757, filed Feb. 25, 2016, and U.S. Provisional Application No. 62/187,539, filed Jul. 1, 2015. The entire contents of application Ser. Nos. 15/200,037, 62/299,757, and 62/187,539 are incorporated herein by reference.

BACKGROUND

The present invention relates lighting devices, and more particularly to portable workspace lighting devices.

SUMMARY

The present invention provides, in one aspect, an area light including a power inlet connectable to a power source, a housing supporting a light assembly, and a user interface including control members configured to operate the light assembly between multiple modes of operation.

In accordance with some constructions, the power source is a battery, the light assembly is an array of LEDs, and the user interface includes a first control member for turning the light assembly on and off and a second control member for operating the light between two or more intensity levels.

In accordance with some constructions, the battery is a 5 amp/hour battery and is capable of providing power to the array of LEDs to produce between 5700 lumens and 7700 lumens for 1 to 3 hours. More specifically, the battery is configured to provide power to the array of LEDs to produce 6700 lumens for about 2 hours.

In accordance with some constructions, the light assembly is an array of 80 to 280 LEDs. More specifically, the light assembly is an array of 180 LEDs. This array of LEDs may be configured to emit light at approximately 3700-4300 Kelvin with a color rendering index (CRI) between about 50 and 100. More specifically, the light that is emitted by the LEDs is about 4000 Kelvin with a CRI of about 70.

In accordance with some constructions, the housing includes a lens surrounding the light assembly. The lens is configured to withstand a two meter drop test. The lens may be removably coupled to the housing. When the lens is coupled to the housing and surrounds the light assembly, approximately 3500-5500 lumens passes through the lens. More specifically, approximately 4500 lumens will pass through the lens.

In one construction, an area light includes a housing defining a central axis and including a first portion and a second portion, the second portion arranged to emit light. A lens is coupled to the housing, and a light assembly is disposed within the second portion. The light assembly includes a plurality of LEDs arranged to emit light through the lens and in a direction that extends 360 degrees around the central axis. A battery is selectively coupled to the housing and is arranged to provide power to the LEDs to allow for the emission of light at a level of at least 5700 lumens for at least two hours.

In another construction, an area light includes a housing defining a central axis and including a first portion and a second portion, a lens coupled to the housing and disposed substantially within the second portion, and a light assembly arranged to emit light from each of a plurality of sectors arranged around the central axis, the plurality of sectors cooperating to completely surround the central axis. A plurality of LEDs is arranged in each of the plurality of sectors, and a control unit is operable to control the distribution of electrical power to the plurality of LEDs, and to selectively direct power to all of the plurality of sectors or to a subset of the plurality of sectors.

In yet another construction, an area light includes a housing defining a central axis and a light assembly defining a plurality of sectors that extend 360 degrees around the central axis, each of the plurality of sectors including a plurality of LEDs arranged to emit light in a direction substantially normal to the central axis. A planar sector is arranged normal to the central axis and includes a plurality of top LEDs arranged to emit light in a direction substantially parallel to the central axis. A lens is coupled to the housing and covers the light assembly and the planar sector, a port is formed as part of the housing and sized to selectively receive a battery, and a power inlet is arranged to selectively receive electrical power from an AC source of power. A control unit is operable to control the distribution of electrical power from one of the port and the power inlet to the plurality of LEDs, and is operable to selectively direct power to all of the plurality of sectors or to a subset of the plurality of sectors.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

FIGS. 1-6 illustrate an area light 10 configured to provide illumination to a workspace. The area light 10 may be held by a user or hung on a support member using features discussed in greater detail below. In addition, the area light 10 may be controlled via a user interface 14 to operate in a plurality of lighting modes.

Figure 1:
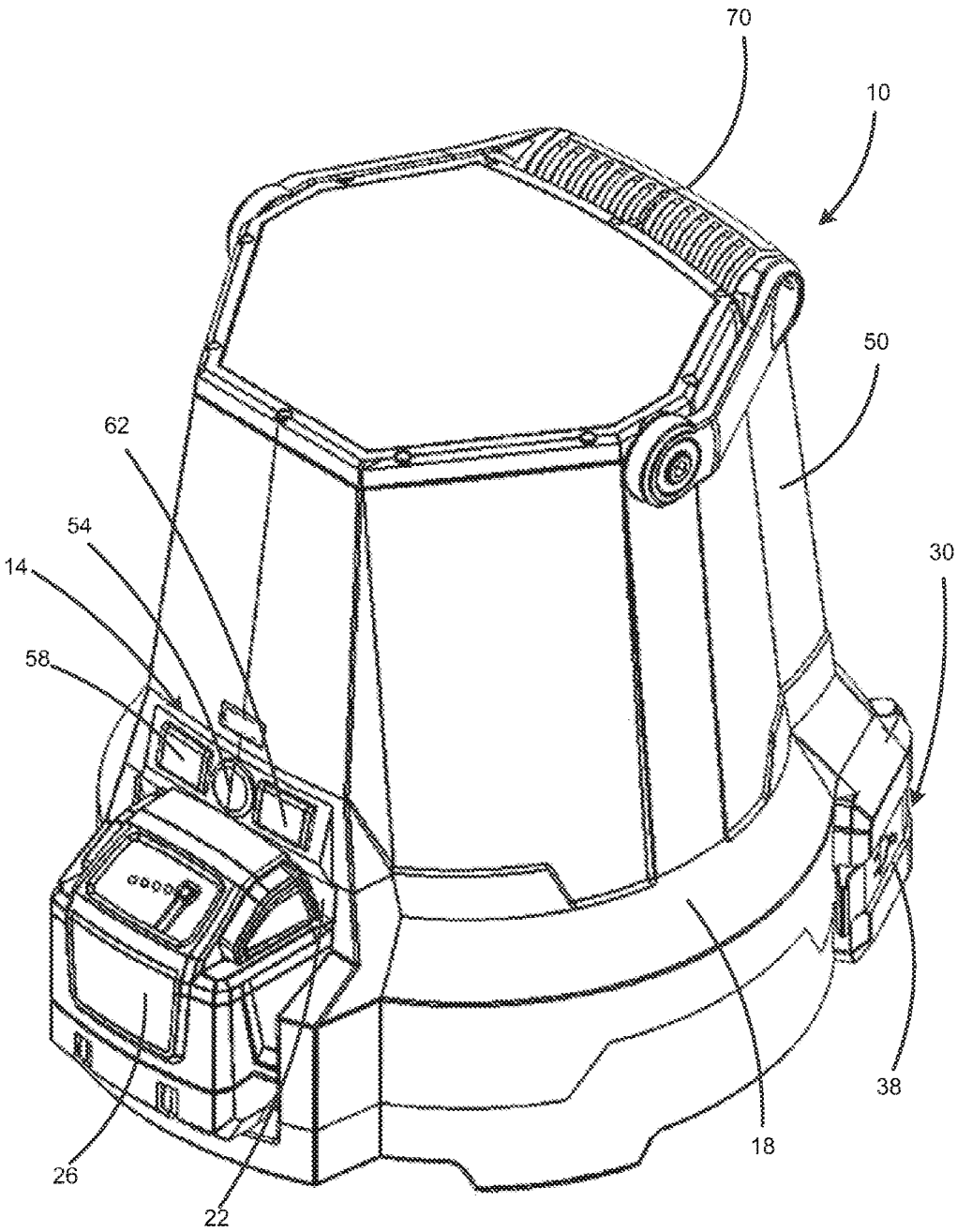
FIG. 1 is a front perspective view of an area light.
Figure 2:
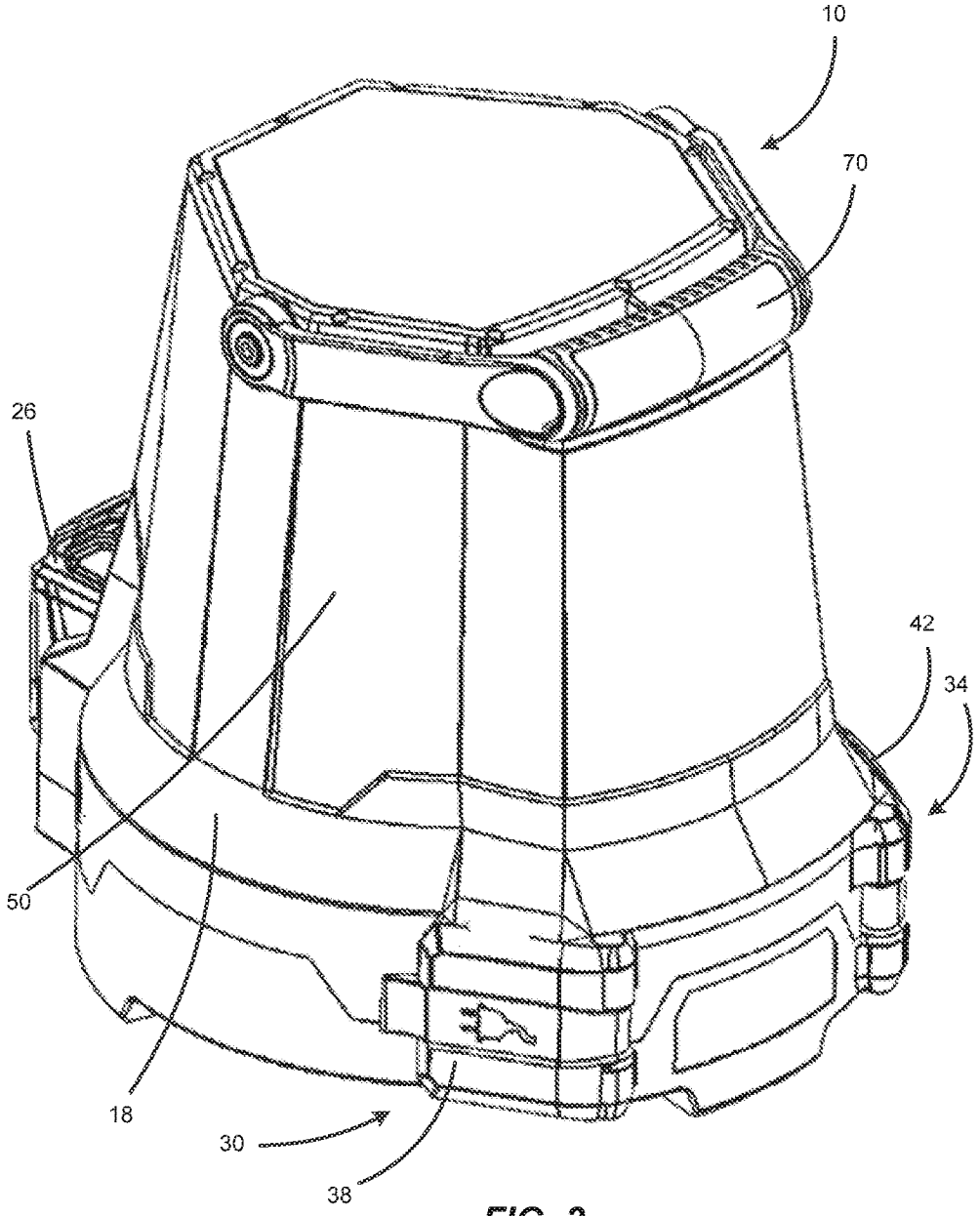
FIG. 2 is a first side, rear perspective view of the area light.
Figure 3:
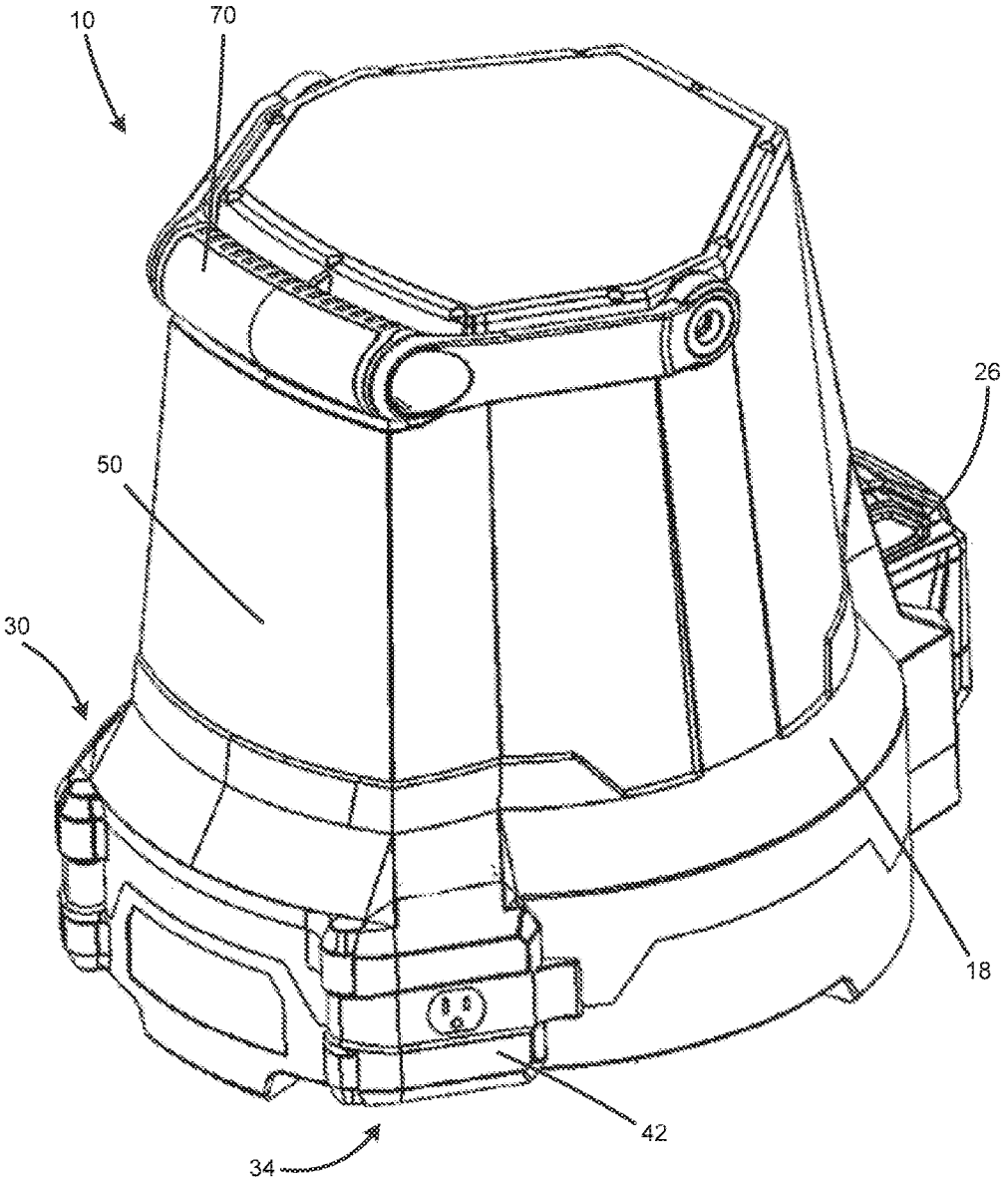
FIG. 3 is a second side, rear perspective view of the area light.

With reference to FIG. 1-3, the area light 10 includes a housing 18 with a port 22 configured to detachably support a battery 26 at one end. The housing 18 also includes a power inlet 30 (e.g., AC power inlet, etc.) and a power outlet 34 (e.g., standard three pin adapter, any standard outlet used in countries around the world, etc.) spaced from the port 22 and configured to, among other things, allow for multiple lights 10 to be connected to the same power source via connections with other lights 10. Put simply, multiple lights 10 may be 'daisy-chained' together. In the illustrated construction, the power inlet 30 and the power outlet 34 are selectively covered by pivoting doors 38, 42 such that the inlet 30 and the outlet 34 may be covered and protected when they are not in use.

The battery 26 and/or an external power source are configured to supply power to a light assembly 46 via the port 22 and the power inlet 30, respectively. In preferred constructions, the battery 26 is a power tool battery pack that can be inserted into the port 22 and removed from the port 22 without any disassembly of the light 10. In one construction, the light assembly 46 includes an array of LEDs. For example, the light assembly 46 may be an array of about 80-280 LEDs. More specifically, the light assembly 46 may be an array of 180 LEDs. In a specific example, the array of LEDs is configured to generate approximately 5700-7700 lumens for about two hours when powered by a 5 amp/hour battery. Further, the light that is emitted by the LEDs is approximately 3700-4300 Kelvin with a color rendering index (CRI) between about 50 and 100. More specifically, the light that is emitted is about 4000 Kelvin with a CRI of about 70.

With reference to FIGS. 1-4, the housing 18 is also configured to support a lens 50 that surrounds the light assembly 46. In some constructions, the lens 50 may be detachably coupled to the housing 18. For example, the lens 50 may be coupled to the housing 18 using a set of fasteners, a ball detent, an interference fit, or other suitable mechanisms.

In some constructions, the lens 50 is be configured to withstand a two meter drop test without any adverse functional effects. This may be accomplished by having a certain lens thickness or by constructing the lens 50 from various materials. In addition, the lens 50 is also configured to have specific light transmission properties—that is, the lens 50 may be configured to transmit a certain percentage, color, or other light characteristic from the light assembly 46 to the surrounding workspace. In a specific example, the lens 50 is configured to transmit approximately 3500-5500 lumens from the light assembly to the work space. More specifically, the lens 50 is configured to transmit 4500 lumens from the light assembly 46 to the work space. The lens also shifts the color temperature of the light by about 200 Kelvin such that the light exiting the lens has a color temperature between about 3500 Kelvin and 4100 Kelvin.

Figure 4:
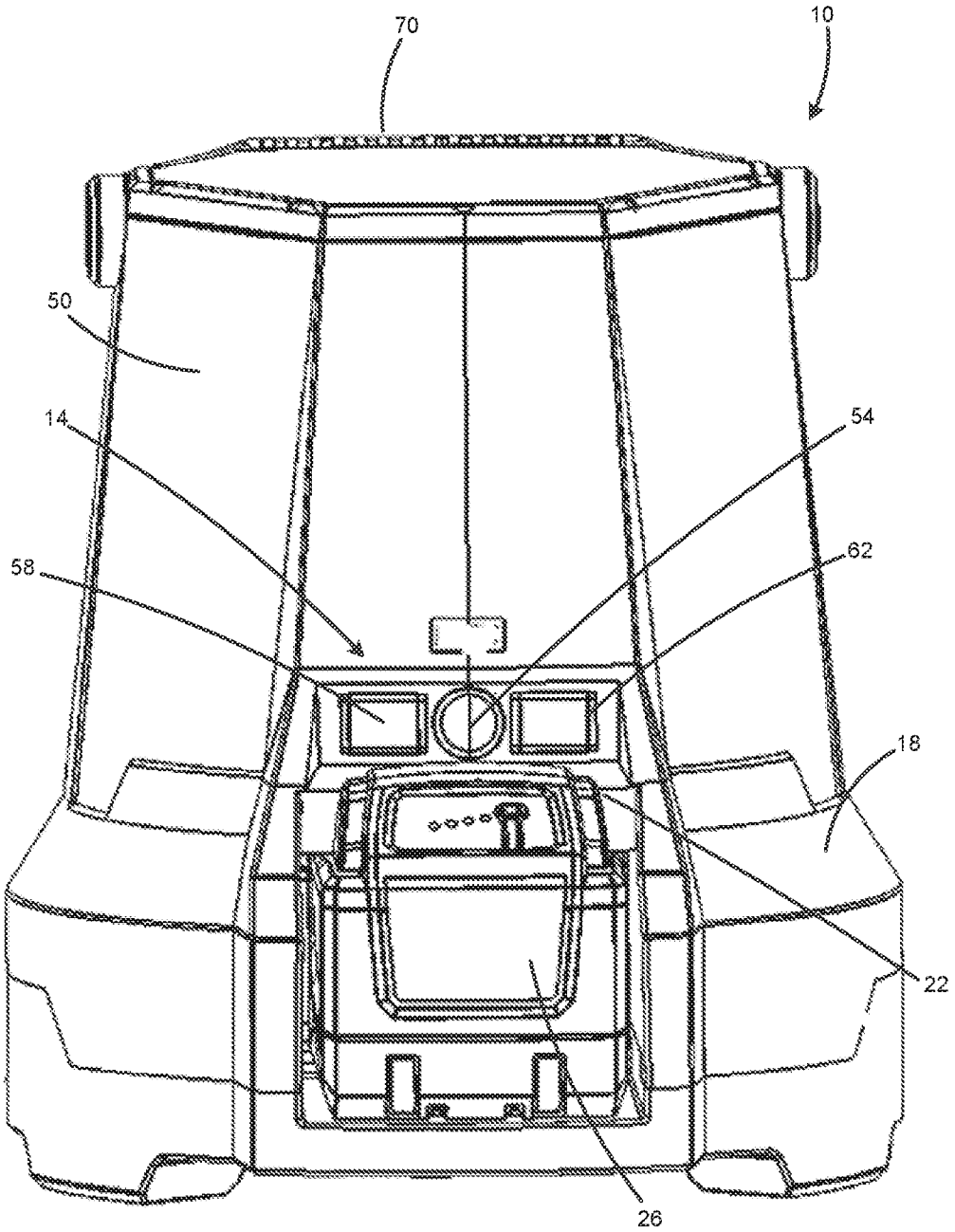
FIG. 4 is a front view of the area light.

With reference to FIGS. 1 and 4, the area light 10 includes the user interface 14 disposed on the housing 18. In the illustrated construction, the user interface 14 includes a first control member 54, a second control member 58, and a third control member 62. The first control member 54 may be a button, switch, or any suitable control mechanism that is configured to toggle the light assembly 46 between an energized state (i.e., on) and a de-energized state (i.e., off). The second control member 58 may also be a button, switch or any suitable control mechanism that is configured to toggle sections of the light assembly 46 on and off. Accordingly, the light assembly 46 may be operated such that only portions of the light assembly 46 are energized. For example, one half (divided along any axis) of the light assembly 46 may be energized while the other half is de-energized, and vice versa. The third control member 62 also may be a button, switch or any suitable control mechanism that is configured to control the intensity of light emitted by the light assembly 46. For example, the third control member 62 may operate the light between a high intensity, medium intensity, and low intensity. Other intermediate intensities may be included as well. In the specific example of the LED light assembly described above, the light intensity control is accomplished using pulse width modulation, although other alternative methods known in the art may be used. While three separate control members are illustrated and described, other constructions may combine some of the functions described into fewer than three control members or may include additional control members that allow for different operating functions.

The area light 10 also includes an internal control unit 66, such as a microcontroller or memory unit storing information and executable functions. The internal control unit 66 is configured to store the state of the light as set by the second and third control members 58, 62 when the light assembly 46 is powered on and off by the first control member 54. This results in a light 10 that may be turned on and off while maintaining the most recent state of the light (e.g., the section of the light turned on and the intensity level), thereby allowing the user to turn the light on with the last settings without having to adjust the light.

Figure 5:
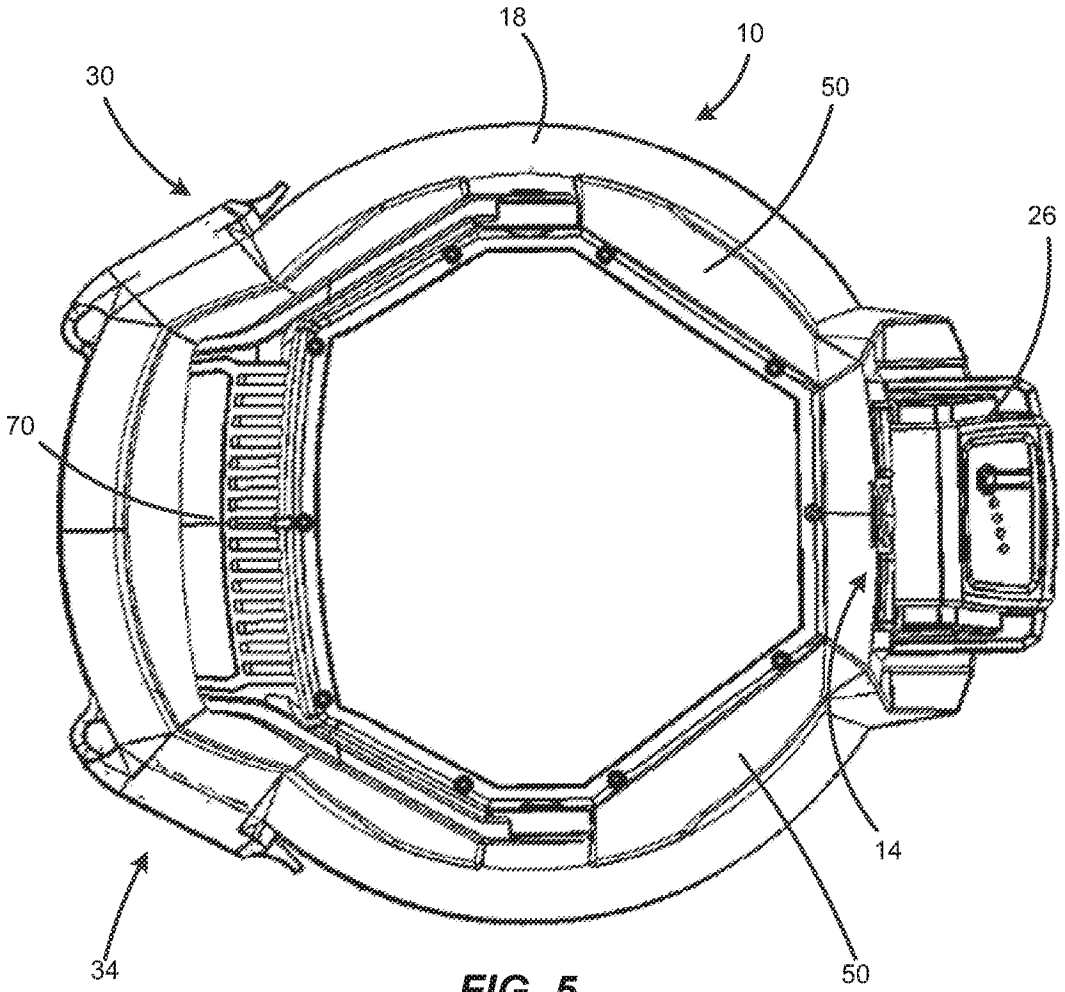
FIG. 5 is a top view of the area light.

With reference to FIG. 5, the area light 10 includes a pivotable handle 70 having a portion configured to be grasped by a user. Alternatively, the handle 70 may also be configured to be hung on a support member within a workspace (e.g., a hook, a rod, etc.) to hang the light above the ground. The handle 70 is shown in a stowed position and is pivotable to a carrying position in which a user can carry the light 10 or hang the light 10 on a support member.

Figure 6:
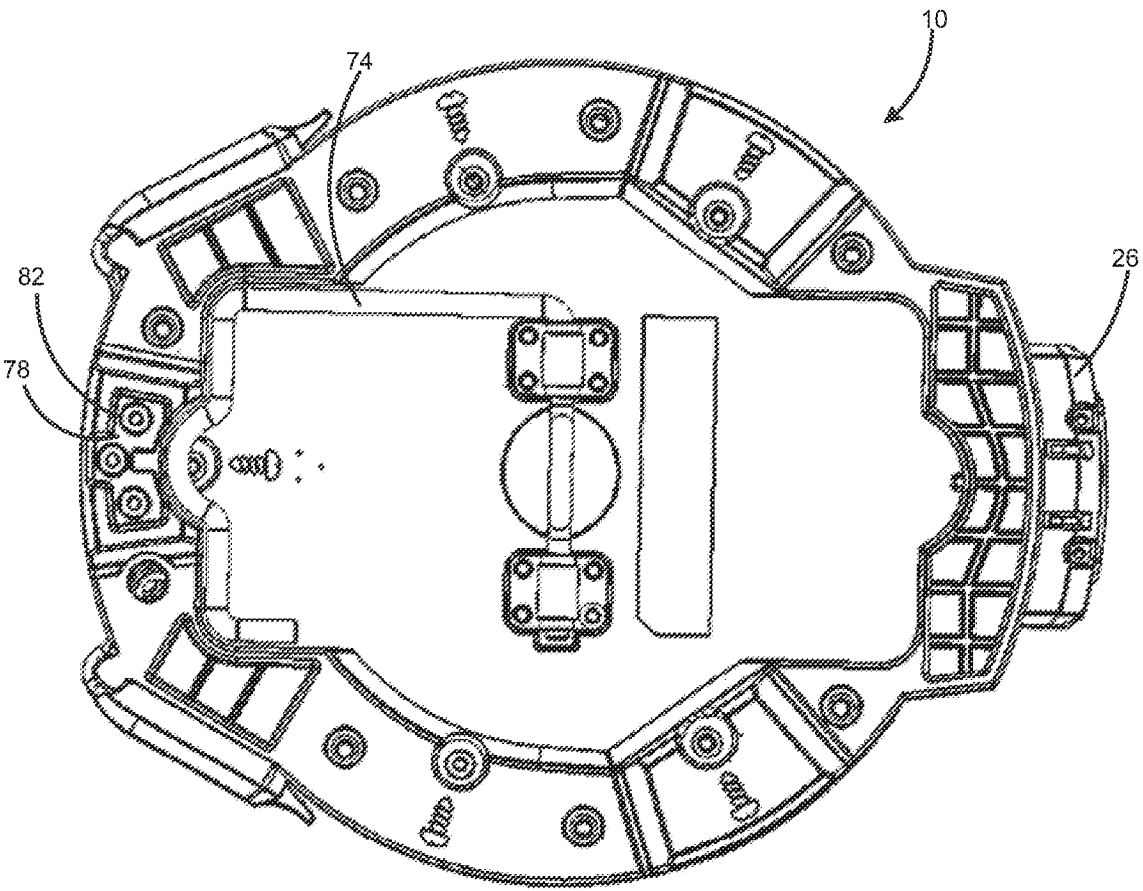
FIG. 6 is a bottom view of the area light.

With reference to FIG. 6, the area light 10 includes a pivotable hook 74 and a reinforced support plate 78 within a slot 82. The pivotable hook 74 defines an open end 76 such that the hook 74 may be pivoted relative to the light 10 in order to facilitate the hanging of the light 10 on a support member within the work space. The slot 82 is configured to receive a support member, such as a fastener head or hook, with the support member abutting the support plate 78. In this manner, the light 10 may be hung within on the support member within the work space.

In operation, the handle 70, the pivotable hook 74, and the slot 82 allow a user to couple the area light 10 to a support member in the work space. Using the user interface 14, the user may energize the light assembly 46 using the first control member 54 and adjust other light assembly characteristics using the second and third control members 58, 62. For example, the user may operate the light assembly at a desired intensity while also energizing only a portion of the light.

The light may also include a power control circuit that allows the light to select the power source from which, or to which power is delivered. For example, the power control circuit could be arranged to deliver power to the LEDs from the external power source when that power source is available and to automatically switch to or select the battery as the source when the external source is not available. In addition, the battery could be charged by the external power source while the external power source delivers power to the LEDs.

Figure 7:
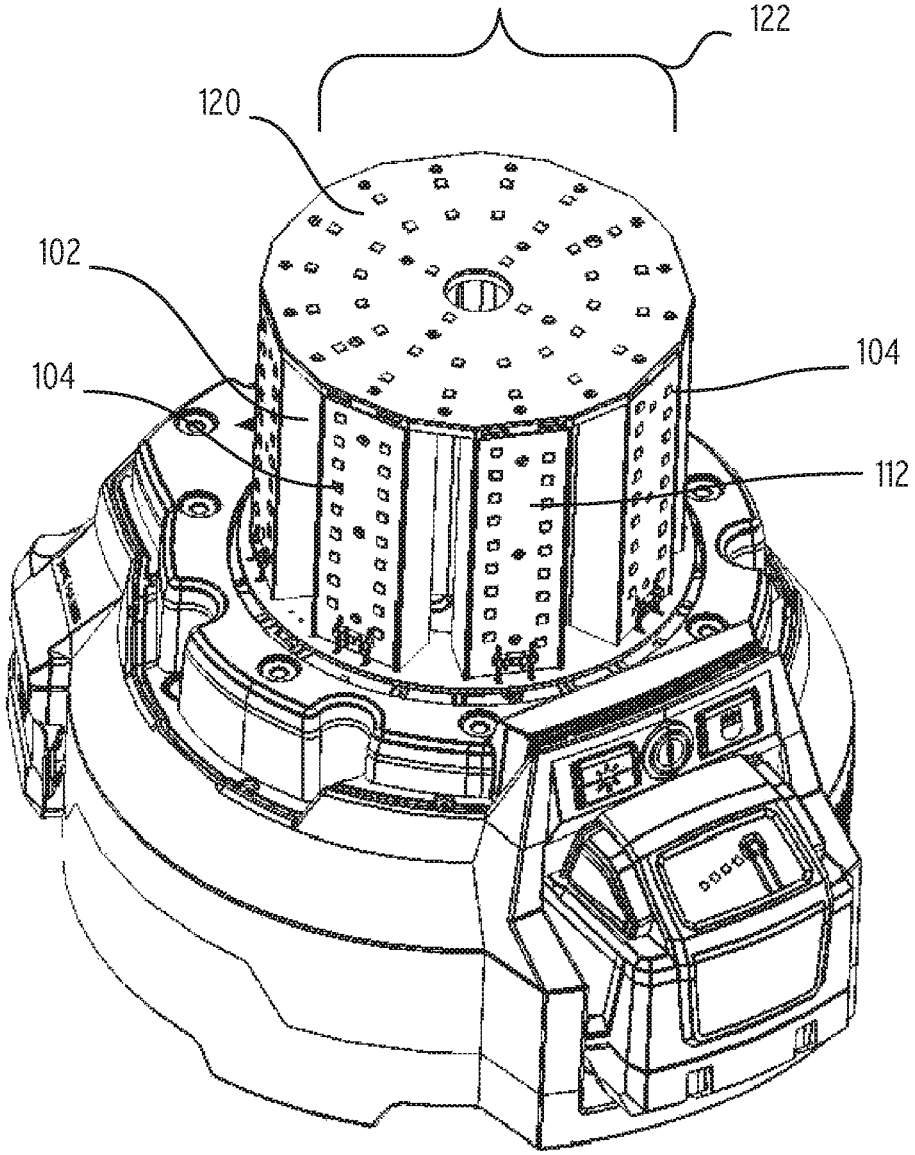
FIG. 7 is a perspective view of the area light of FIG. 1 with the lens removed.
Figure 8:
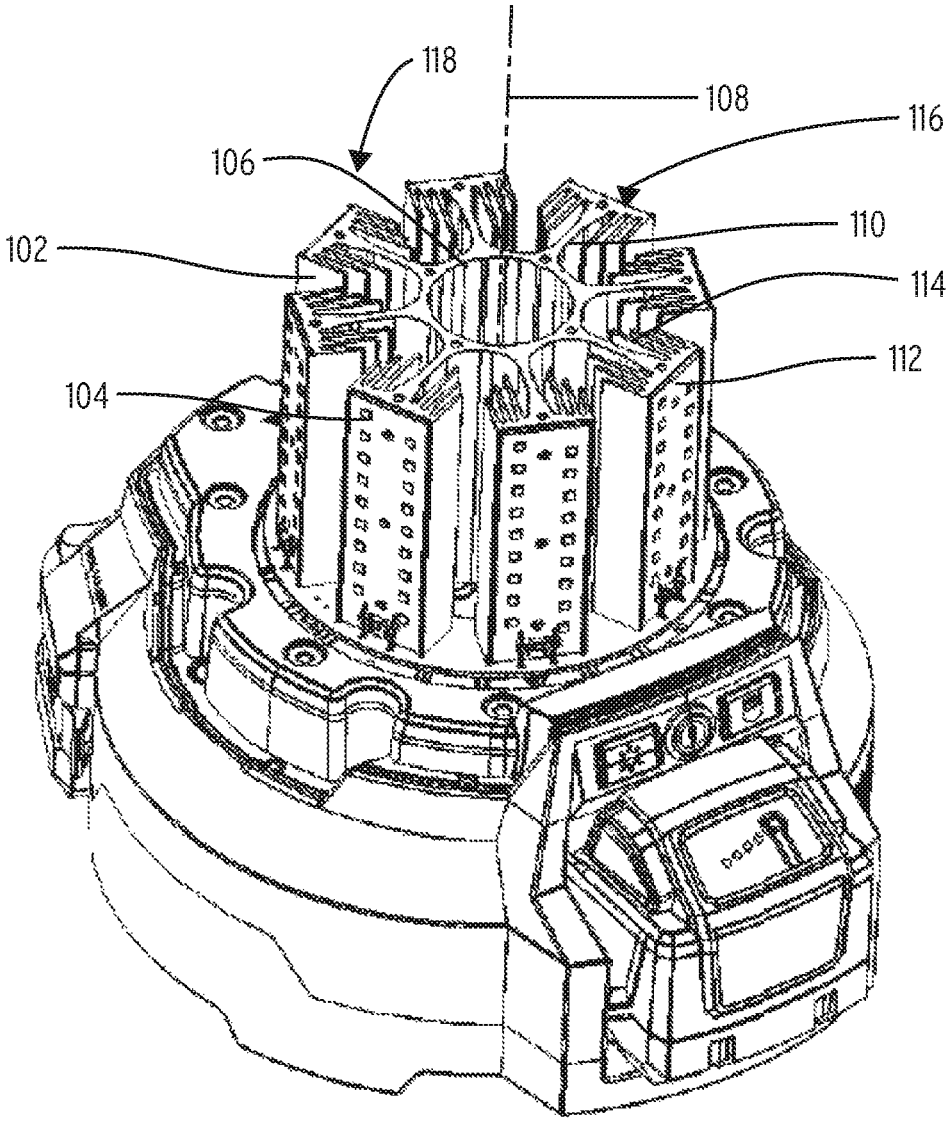
FIG. 8 is a perspective view of the area light of FIG. 7 with a portion of the light assembly and the lens removed.

FIGS. 7 and 8 show the area light of FIGS. 1-6 with the lens 50 removed to better illustrate features of the light assembly 46. With reference to FIG. 8, the light assembly 46 includes a heat sink 102 that supports a quantity of LEDs 104. The heat sink 102 includes a central tube portion 106 that extends along a central axis 108 and eight arms 110 extending radially outward from the central tube 106. Each of the arms 110 includes an outward facing surface 112 on which a number of LEDs 104 are attached. A number of fins 114 extend inward toward the central tube 106 from the outward facing surface 112 to enhance the cooling ability of the heat sink 102. Each of the arms 110 (or groups of arms 110) defines a sector 116, with the sectors 116 extending 360 degrees around the central axis 108 or the central tube 106. The user interface 14, first control member 54, second control member 58, third control member 62, or control unit are operable to activate the LEDs 104 on a per sector basis. Thus, in use, a user could activate the LEDs 104 on a single sector 116 or multiple sectors 116 as may be desired. In one construction, two adjacent arms 110 define a sector 118 such that the user can activate the light to illuminate a 90 degree wedge, a 180 degree wedge, a 270 degree wedge, or the entire 360 degree area around the light 10. The control unit is capable of storing the on/off configuration of the various sectors 116, 118 when the light 10 is turned off to allow the same sector on/off configuration when the light 10 is reactivated.

As illustrated in FIG. 7, a plate 120 is positioned on top of the heat sink 102 and includes a number of LEDs 104 arranged to direct light in a direction parallel to the central axis 108. The plate 120 and LEDs 104 define a planar sector 122 that can be controlled as a separate sector 122 as discussed with regard to FIG. 8 or can be grouped with another sector 116, 118 of the light 10.

Although the invention has been described in detail with reference to certain preferred embodiments, variations and modifications exist within the scope and spirit of one or more independent aspects of the invention as described.

What is claimed is:

1. An area light comprising:

a housing defining a central axis and having a first end and a second end that is opposite the first end, the housing having a side including a battery port adjacent the second end;

a lens coupled to the first end of the housing;

a light assembly disposed within the lens, the light assembly including a heat sink having a surface facing away from the first end of the housing and a plurality of arms extending radially outward from the central axis, the surface including one or more LEDs arranged to emit light through the lens and in a direction that extends 360 degrees around the central axis;

a battery selectively coupled to the battery port and arranged to provide power to the one or more LEDs;

a hook coupled to the second end of the housing;

a slot on the second end of the housing and configured to receive a support member that is configured to support the light;

a user interface including a first control member configured to turn the one or more LEDs on and off, and a second control member configured to switch the one or more LEDs between a first intensity and a second intensity that is higher than the first intensity; and a control unit operable to control the distribution of electrical power to the one or more LEDs, the control unit configured to store a current intensity level of the one or more LEDs when the light assembly is powered off, such that the one or more LEDs return to the current intensity level when the light assembly is turned back on, wherein the light passing through the lens has a range of between 3500 and 5500 lumens.

2. The area light of claim 1, further comprising a support plate arranged in the slot.

3. The area light of claim 1, wherein the one or more LEDs are selected to emit light with a color rendering index between 50 and 100.

4. The area light of claim 3, wherein the light passing through the lens has a temperature that is between 3500 and 4100 Kelvin.

5. The area light of claim 1, wherein the hook is coupled to a central region of the second end of the housing, the central region being intersected by the central axis.

6. The area light of claim 5, wherein the lens has a width that tapers as the lens extends away from the first end of the housing.

7. The area light of claim 6, wherein the lens is detachably coupled to the first end of the housing.

8. An area light comprising:

a housing defining a central axis and having a first end and a second end that is opposite the first end;

a lens coupled to a first end of the housing and having a width, the width of the lens tapering as the lens extends away from the first end of the housing;

a light assembly including one or more LEDs arranged to emit light through the lens and in a direction that extends 360 degrees around the central axis;

a control unit operable to control the distribution of electrical power to the plurality of LEDs;

a pivotable hook coupled to the second end of the housing, the pivotable hook configured to pivot with respect to the second end of the housing; and a handle coupled to the housing and configured to allow a user to carry the area light, wherein the light passing through the lens has a range of between 3500 and 5500 lumens.

9. The area light of claim 8, wherein the light assembly includes a heat sink having a plurality of arms, and wherein the one or more LEDs are arranged on a side of the heat sink opposite the housing.

10. The area light of claim 8, wherein the one or more LEDs are selected to emit light with a color rendering index between 50 and 100.

11. The area light of claim 10, wherein light passing through the lens has a temperature that is between 3500 and 4100 Kelvin.

12. The area light of claim 8, further comprising a battery selectively coupled to the housing and arranged to provide power to the one or more LEDs to allow for the emission of light at a level of at least 5700 lumens for at least two hours.

13. The area light of claim 12, wherein the battery is a power tool battery pack that is removable from the housing without disassembly of the housing.

14. The area light of claim 12, wherein the battery is supported by the housing in a battery port arranged between the light assembly and the second end of the housing.

15. The area light of claim 8, wherein the light assembly is also configured to emit light through the lens in a direction that is parallel to the central axis.

16. The area light of claim 15, wherein the control unit is configured to store a current intensity level of the one or more LEDs when the light assembly is powered off, such that the one or more LEDs return to the current intensity level when the light assembly is turned back on.

17. An area light comprising:

a housing defining a central axis and having a first end and a second end that is opposite the first end;

a light assembly including a heat sink with a surface and a plurality of arms extending radially outward from the central axis, the light assembly including one or more LEDs on the surface facing in a direction away from the housing;

a lens coupled to the first end of the housing and covering the light assembly, the lens having a width that tapers in a direction extending away from the first end of the housing;

a port formed on the housing and sized to selectively receive a battery, the port arranged between the first and second ends of the housing;

a user interface including a first control member configured to turn the one or more LEDs on and off, and a second control member configured to switch the one or more LEDs between a first intensity and a second intensity that is higher than the first intensity; and a pivotable hook coupled to the second end of the housing, the pivotable hook configured to pivot with respect to the second end of the housing, wherein the light passing through the lens has a range of between 3500 and 5500 lumens, wherein the one or more LEDs emit light with a color rendering index between 50 and 100, and wherein the light passing through the lens has a temperature range that is between 3500 and 4100 Kelvin.

18. The area light of claim 17, further comprising a slot on the second end of the housing and configured to receive a support member that is configured to support the light.

19. The area light of claim 18, further comprising a support plate arranged in the slot.

20. The area light of claim 17, wherein the light assembly is configured to emit light through the lens in a direction that extends 360 degrees around the central axis and in a direction that is parallel to the central axis.

21. The area light of claim 8, wherein the pivotable hook is coupled to a central region of the second end of the housing, the central region being intersected by the central axis.

22. The area light of claim 17, wherein the pivotable hook is coupled to a central region of the second end of the housing, the central region being intersected by the central axis.

* * * * *